US009700154B2

(12) United States Patent
Goppion

(10) Patent No.: US 9,700,154 B2
(45) Date of Patent: Jul. 11, 2017

(54) SHOWCASE WITH TWO STEP COMPLEX OPENING

(71) Applicant: GOPPION S.p.A., Trezzano Sul Naviglio (MI) (IT)

(72) Inventor: Alessandro Goppion, Milan (IT)

(73) Assignee: GOPPION S.p.A., Trezzano Sul Naviglio (MI) (IT)

( * ) Notice: Subject to any disclaimer, the term of this patent is extended or adjusted under 35 U.S.C. 154(b) by 0 days.

(21) Appl. No.: 14/790,766

(22) Filed: Jul. 2, 2015

(65) Prior Publication Data

US 2016/0000236 A1 Jan. 7, 2016

(30) Foreign Application Priority Data

Jul. 2, 2014 (IT) ..... MI2014A1206

(51) Int. Cl.
*A47F 3/00* (2006.01)
*A47F 3/14* (2006.01)
(Continued)

(52) U.S. Cl.
CPC ..... *A47F 3/145* (2013.01); *A47F 3/004* (2013.01); *A47F 3/005* (2013.01); *E05D 3/02* (2013.01);
(Continued)

(58) Field of Classification Search
CPC .. A47F 3/00; A47F 3/004; A47F 3/005; A47F 3/0434; A47F 3/145; E05D 3/02; E05D 3/14; E05D 15/46; E05D 15/56
(Continued)

(56) References Cited

U.S. PATENT DOCUMENTS 1,380,222 A * 5/1921 Lichtenberg ..... A47B 67/005 248/486
2,023,260 A 12/1935 Beers et al.
(Continued)

FOREIGN PATENT DOCUMENTS

DE 4110942 10/1991
DE 19739394 A1 3/1999
(Continued)

OTHER PUBLICATIONS

Italian Search Report issued on Feb. 20, 2015 for MI2014A001206 filed on Jul. 2, 2014 in the name of Goppion S.p.A.
(Continued)

*Primary Examiner* — James O Hansen
(74) *Attorney, Agent, or Firm* — Steinfl + Bruno LLP

(57) ABSTRACT

A showcase for preservation and display of objects is described. The showcase has a fixed casing and at least one openable panel made of glass mounted on the fixed casing through opening supports, which have a pair of upper rods and a pair of lower rods, all having the same length as each other, pivoted to the fixed casing at respective first upper and lower rod pins, and an intermediate structure, pivoted to the upper and lower rods at respective second upper and lower rod pins. A hinging system is provided along the main direction, between the openable panel and the intermediate structure, so as to allow the openable panel to rotate with respect to the intermediate structure. The opening is divided substantially into two steps, with a first roto-translational movement of the intermediate structure and with it of the openable panel with respect to the case, and a second step, in which the hinging system is used to allow the openable panel to rotate with respect to the intermediate structure, until a completely open position is reached.

14 Claims, 14 Drawing Sheets

(51) Int. Cl.

| | |
|---|---|
| ***E05D 3/02*** | (2006.01) |
| ***E05D 3/14*** | (2006.01) |
| ***E05D 15/46*** | (2006.01) |
| ***E05D 15/56*** | (2006.01) |

(52) U.S. Cl.
CPC ..... *E05D 3/14* (2013.01); *E05D 15/46* (2013.01); *E05D 15/56* (2013.01); *A47F 2003/008* (2013.01); *E05Y 2900/204* (2013.01)

(58) Field of Classification Search
USPC ..... 312/114, 138.1, 139, 139.1, 139.2
See application file for complete search history.

(56) References Cited

U.S. PATENT DOCUMENTS

| | | | | |
|---|---|---|---|---|
| 3,341,267 | A | 9/1967 | Weitzman | |
| 3,998,509 | A | 12/1976 | Hauser | |
| 4,660,903 | A | 4/1987 | Shinagawa | |
| 5,120,116 | A | 6/1992 | Amstutz et al. | |
| 5,524,977 | A | 6/1996 | Orawski | |
| 6,398,322 | B1 | 6/2002 | Chaplin | |
| 6,758,539 | B2 * | 7/2004 | Cianetti | A47F 3/007 312/137 |
| 7,780,249 | B2 * | 8/2010 | Cianetti | A47F 3/007 312/137 |
| 2006/0028102 | A1 | 2/2006 | Hahn | |
| 2015/0022066 | A1 | 1/2015 | Dimitrakos | |
| 2015/0130334 | A1 | 5/2015 | Goppion | |

FOREIGN PATENT DOCUMENTS

| | | | |
|---|---|---|---|
| DE | 10341934 | | 5/2005 |
| DE | 202006017556 | U1 | 2/2007 |
| EP | 1854953 | A2 | 11/2007 |
| GB | 1959 | | 0/1911 |
| GB | 726873 | | 3/1955 |
| GB | 2245155 | | 1/1992 |
| JP | 2000160921 | A | 11/1999 |
| WO | 2006/070428 | | 7/2006 |

OTHER PUBLICATIONS

Italian Written Opinion issued on Feb. 20, 2015 for MI2014A001206 filed on Jul. 2, 2014 in the name of Goppion S.p.A.
Italian Search Report for MI20141205 filed Jul. 2, 2014 in the name of Goppion S.p.A. Mail Date: Feb. 10, 2015.
Italian Written Opinion for MI20141205 filed Jul. 2, 2014 in the name of Goppion S.p.A. Mail Date: Feb. 10, 2015.
Italian Search Report for MI2014A1391 filed Jul. 31, 2014 in the name of Goppion S.p.A. Mail Date: Mar. 19, 2015.
Italian Written Opinion for MI2014A1391 filed Jul. 31, 2014 in the name of Goppion S.p.A. Mail Date: Mar. 19, 2015.
Restriction Requirement for U.S. Appl. No. 14/709,829 filed Jul. 2, 2015 on behalf of Alessandro Goppion. Mail Date: Oct. 25, 2016. 5 pages.
Non-Final Office Action for U.S. Appl. No. 14/811,753 filed Jul. 28, 2015 on behalf of Alessandro Goppion. Mail Date: Feb. 9, 2016. 9 pages.
Notice of Allowance for U.S. Appl. No. 14/811,753 filed Jul. 28, 2015 on behalf of Alessandro Goppion. Mail Date: Feb. 9, 2016. 6 pages.

* cited by examiner

SHOWCASE WITH TWO STEP COMPLEX OPENING

CROSS-REFERENCE TO RELATED APPLICATIONS

The present application claims priority to Italian Application MI2014A001206 filed on Jul. 2, 2014, which is incorporated herein by reference in its entirety.

FIELD

The present invention refers to a showcase for preservation and display of objects in a protected environment, such as typically works of art, objects of cultural heritage or in any case delicate objects, in museums, exhibitions and the like.

Here and hereafter, protected environment means an environment in which the atmosphere is controlled, through monitoring of one or more parameters from temperature, humidity, dust content, pollutant content, in order to maintain the foreseen storage conditions of the objects on display, and in which unauthorised people are prevented from being able to gain access to them, in order to avoid theft or damage to the objects on display.

BACKGROUND

Showcases of this type must therefore satisfy various kinds of requirements, in relation to the storage and integrity of the objects displayed. Moreover, of course, these showcases must ensure maximum visibility of the objects displayed.

In order to improve visibility, manufacturers of showcases try as much as they can to use transparent materials—typically glass—for the walls of the showcase. As well as ensuring maximum visibility of the objects displayed, the extensive use of glass is often desired by designers of showcases because the transparency of the material allows the objects displayed to be given maximum visual impact.

Therefore, showcases have been developed having a base block with a case formed by panels on top; the base block houses all of the technical components necessary to ensure that the environment inside the case is protected and is thus normally closed by non-transparent walls, which hide all of the technical components from view; vice-versa, the walls of the case are made entirely or partially from glass, for the aforementioned reasons.

The possibility of access to the inside of the case, for the housing, removal or maintenance of the objects displayed, is normally obtained by providing for at least one of the side panels to be openable. For this purpose, opening supports of various kinds are used, which allow opening by rotation or roto-translation of the panel (more or less complex hinges) or by sliding (sliding guides). These opening supports must clearly ensure the correct closure of the openable panel, but must also allow an opening that is as wide as possible, so as to make access possible and easy also to arrange very large-sized objects (relative to the size of the showcase), possibly also in cases in which the weight of the object forces the uses of a fork lift or similar to move the object.

Therefore, there is a problem of maximising the degree of opening of the openable panel, even in the presence of panels made of transparent material.

Consequently, the present invention concerns a showcase as defined herein.

In particular, the invention concerns a showcase for preservation and display of objects, comprising a fixed casing and at least one openable panel made of glass mounted on the fixed casing through opening supports, characterised in that the opening supports comprise:

- a pair of upper rods and a pair of lower rods, all having a same length, pivoted to the fixed casing at respective first upper and lower rod pins;
- an intermediate structure, pivoted to the upper and lower rods at respective second upper and lower rod pins;

wherein the rod pins have a pivoting axis parallel to a main direction;

wherein the distance on the fixed casing between the first upper rod pins and the distance on the intermediate structure between the second upper rod pins are equal to each other, as well as the distance on the fixed casing between the first lower rod pins and the distance on the intermediate structure between the second lower rod pins are equal to each other, so that the four rods form an articulated parallelogram system for the movement of the intermediate structure with respect to the fixed casing;

- and a hinging system along the main direction, between the openable panel and the intermediate structure, so as to allow the openable panel to rotate with respect to the intermediate structure.

With this structure, the opening of the openable panel is divided substantially into two steps.

In a first step, the parallelogram system formed by the rods determines a roto-translational movement of the intermediate structure and with it of the openable panel with respect to the case, so that the openable panel passes from the closed position, in which the openable panel completely closes an opening space of the fixed casing, to a partially open position, in which the openable panel leaves a part of the opening space of the fixed casing partially free. In this first step of opening, the hinging system between intermediate structure and openable panel is left inactive (and possibly blocked), so that the openable panel and the intermediate structure move jointly.

In a second step, it is the parallelogram system that is left inactive (and possibly blocked), so that the intermediate structure remains fixed to the fixed casing, whereas the hinging system is used to allow the openable panel to rotate with respect to the intermediate structure, until it reaches a completely open position. In this position, the openable panel can be positioned on the side of the fixed casing and the opening space is thus made completely free, so as to allow easy access to objects of any size.

Closing clearly proceeds in reverse, also in two steps.

Preferably, the intermediate structure comprises at least an upper bar and a lower bar, respectively pivoted to the upper and lower rods at the second upper and lower rod pins. Preferably, the openable panel comprises at least an upper bar and a lower bar, respectively pivoted to the upper bar and to the lower bar of the intermediate structure through the hinging system. Preferably, the hinging system comprises an upper hinge between the upper bars of the intermediate structure and of the panel and a lower hinge between the lower bars of the intermediate structure and of the panel. These solutions all help to obtain the maximum structural simplicity, whilst ensuring the aforementioned possibilities of actuation.

In a preferred embodiment, the upper hinge and the lower hinge are two roto-translational complex hinges. Here and hereafter the expression "roto-translational complex hinges" means to indicate a hinging mechanism that is not limited to ensuring a simple possibility of rotation between the parts, but rather ensures that the rotation between the parts is also associated with a translation. Complex hinges of this kind are per se known and are obtained with systems of rods and pins, variously configured according to the roto-translational movement that is wished to be obtained.

Preferably, each of the two roto-translational complex hinges comprises a first fork fixed to one of the bars, a second fork fixed to the other of the bars, and three rods pivoted between the first and the second fork, in which:

- a central one of the rods is pivoted to the first fork between opposite arms thereof according to a first pivoting axis,
- the central rod is pivoted to the second fork between opposite arms thereof according to a second pivoting axis,
- two outer ones of the rods are pivoted to the first fork outside of the arms thereof according to a third pivoting axis,
- the two outer rods are pivoted to the second fork outside of the arms thereof according to a fourth pivoting axis, in which the four pivoting axes are parallel to each other and to the main direction, and in which, moreover:

- on the first fork, the first pivoting axis is located between the third pivoting axis and the ends of the arms of the first fork,
- on the second fork, the fourth pivoting axis is located between the second pivoting axis and the ends of the arms of the second fork.

Even more preferably, the two complex hinges are fixed with the respective first forks to the bars of the intermediate structure and with the respective second forks to the bars of the openable panel.

Hinges thus configured ensure that the bars of the openable panel rotate with respect to the bars of the fixed structure and at the same time move away from them, thus facilitating the passing over the edge of the case of the showcase, even when it has an acute angle.

In another preferred embodiment, the upper hinge and the lower hinge are two simple pin hinges. This solution is clearly simpler and more cost-effective and may be preferred when the passing over the edge of the case of the showcase is not problematic, for example because the corresponding angle is sufficiently large.

Preferably, the hinging system is positioned at about half of the width of the openable panel. This feature ensures that the openable panel is supported by the intermediate structure in a substantially barycentric position; with openable panels of large dimensions and of high weight, this feature thus makes it possible to more easily maintain conditions of static equilibrium of the openable panel during opening and closing.

Preferably, the rods, in closure conditions of the openable panel, are extended parallel to the openable panel, and the length of the rods between the first and the second rod pins is equal to about one quarter of the width of the openable panel.

In this way, in the first part of the opening step the openable panel moves in a direction away from the opening space of the fixed casing, and equally in the final part of the closure step the openable panel moves in a direction towards the opening space of the fixed casing. Therefore, the invention can thus be used directly also on showcases that have—between the openable panel and the fixed casing—a seal obtained through compression gaskets, i.e. without it being necessary to provide any specific different movement to obtain the compression/decompression of the gaskets.

The main direction, according to which both the hinging system and the pivoting axes are arranged, is typically vertical, since it is the position of the openable panel of most showcases; however, this does not mean that it cannot be oriented differently, for example inclined with respect to the vertical or even horizontal, according to the configuration of the showcase.

Preferably, the showcase comprises support and sliding guides mounted on the fixed casing in a position such as to provide support for the rods when the openable panel is in complete or partial closure and/or opening position. This facilitates the movement even in the presence of heavy doors and makes it more precise; in particular, this support can be very useful in the closure position (and in intermediate positions close thereto), to ensure the precision of closure of the openable panel.

BRIEF DESCRIPTION OF DRAWINGS

Further characteristics and advantages of a showcase according to the invention will become clearer from the following description of some preferred embodiments thereof, made with reference to the attached drawings. In such drawings.

DETAILED DESCRIPTION

Figure 1:
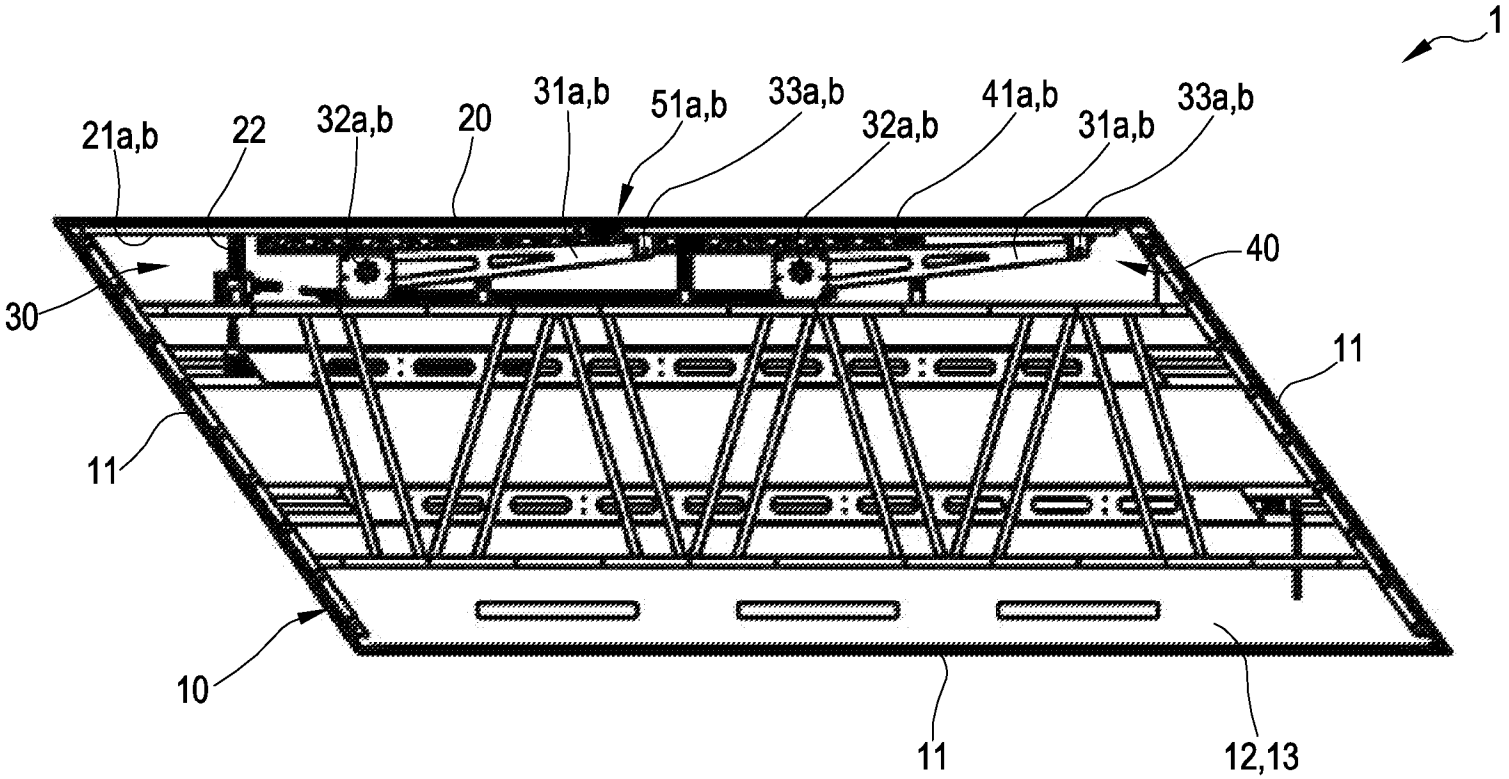
FIG. 1 is a schematic view from above of a showcase according to a first embodiment of the invention, with openable panel in closure position.
Figure 2:
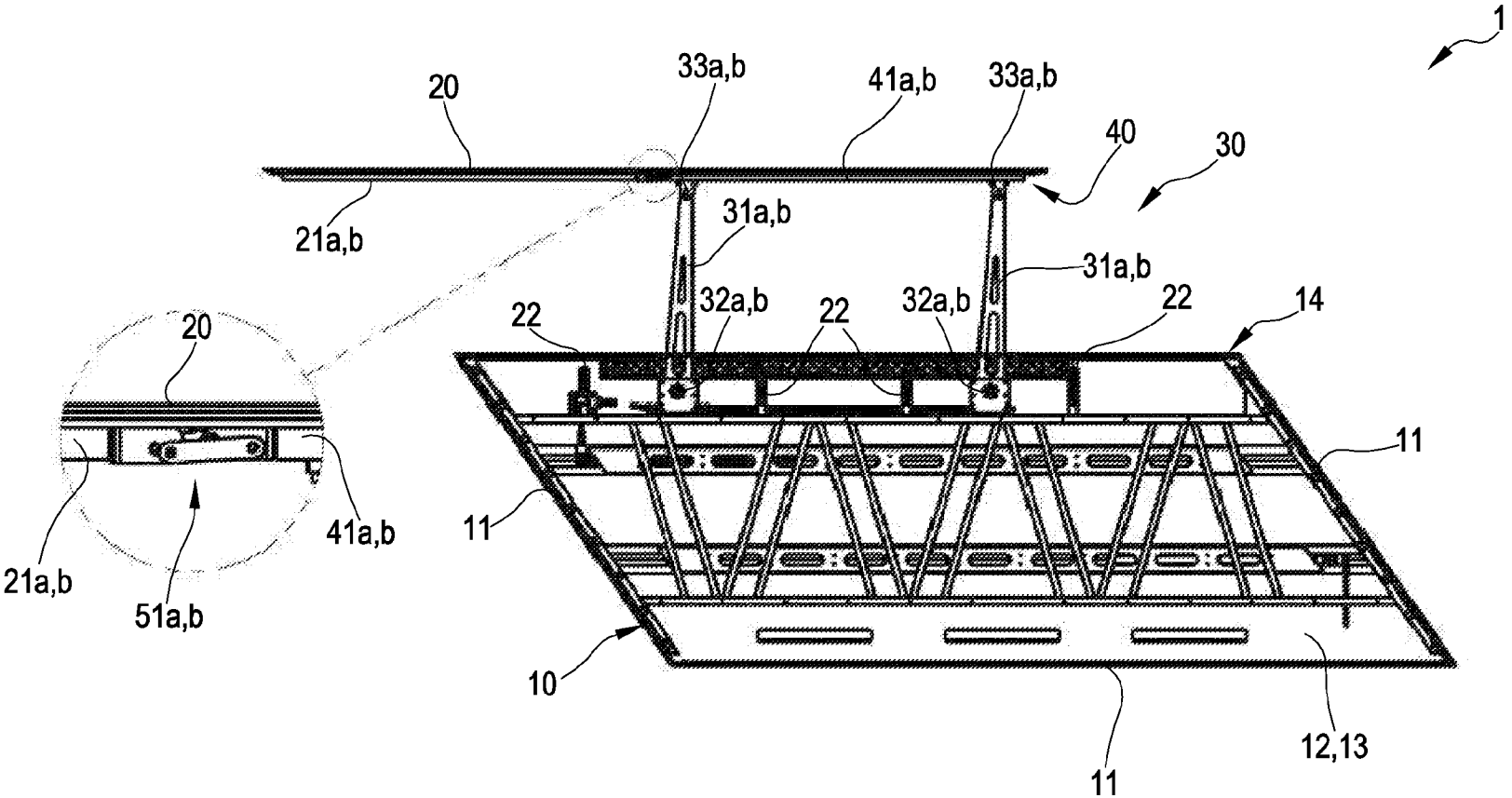
FIG. 2 is a schematic view from above of the showcase of FIG. 1, with openable panel in the step of passing from the closure position to the partially open position.
Figure 3:
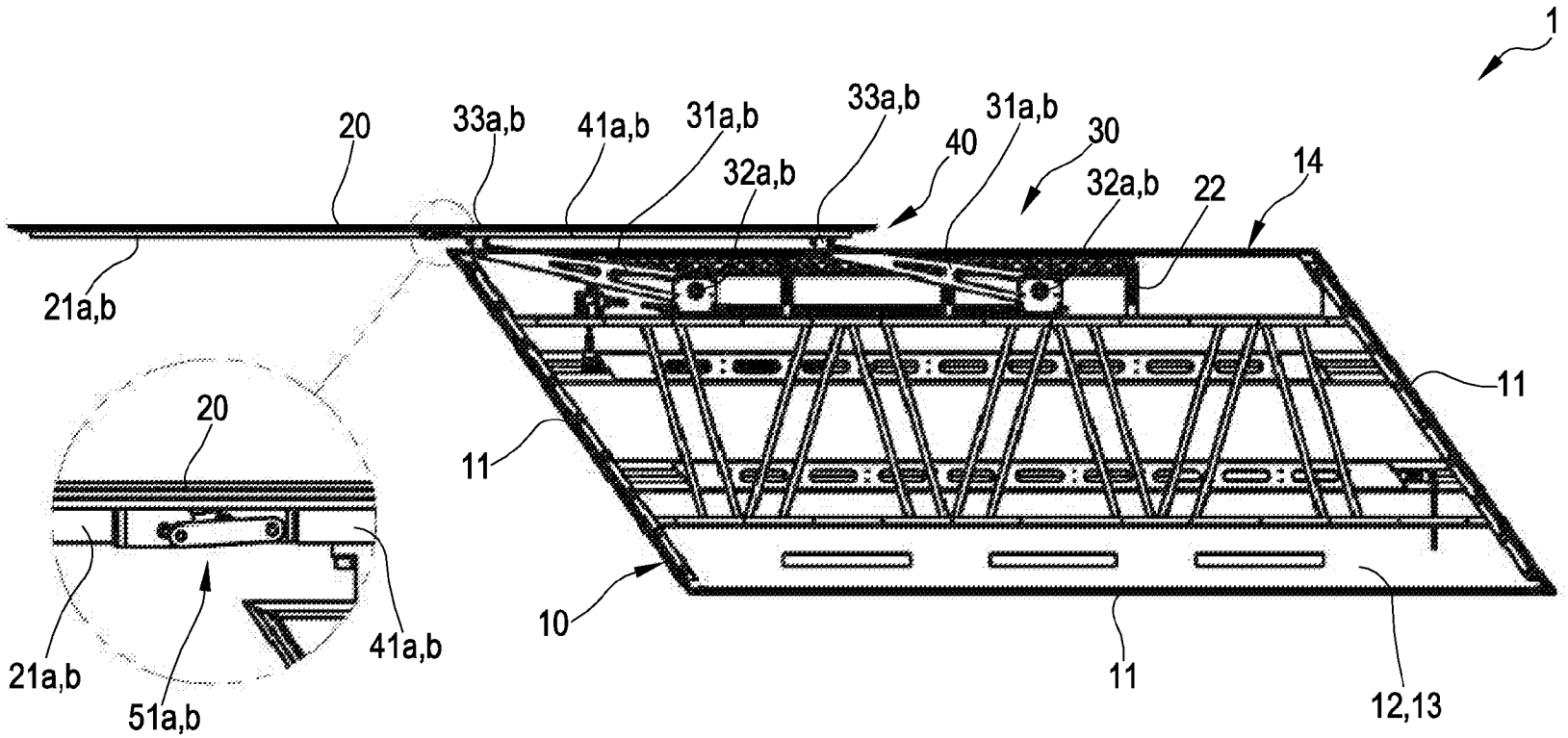
FIG. 3 is a schematic view from above of the showcase of FIG. 1, with openable panel in partially open position.
Figure 4:
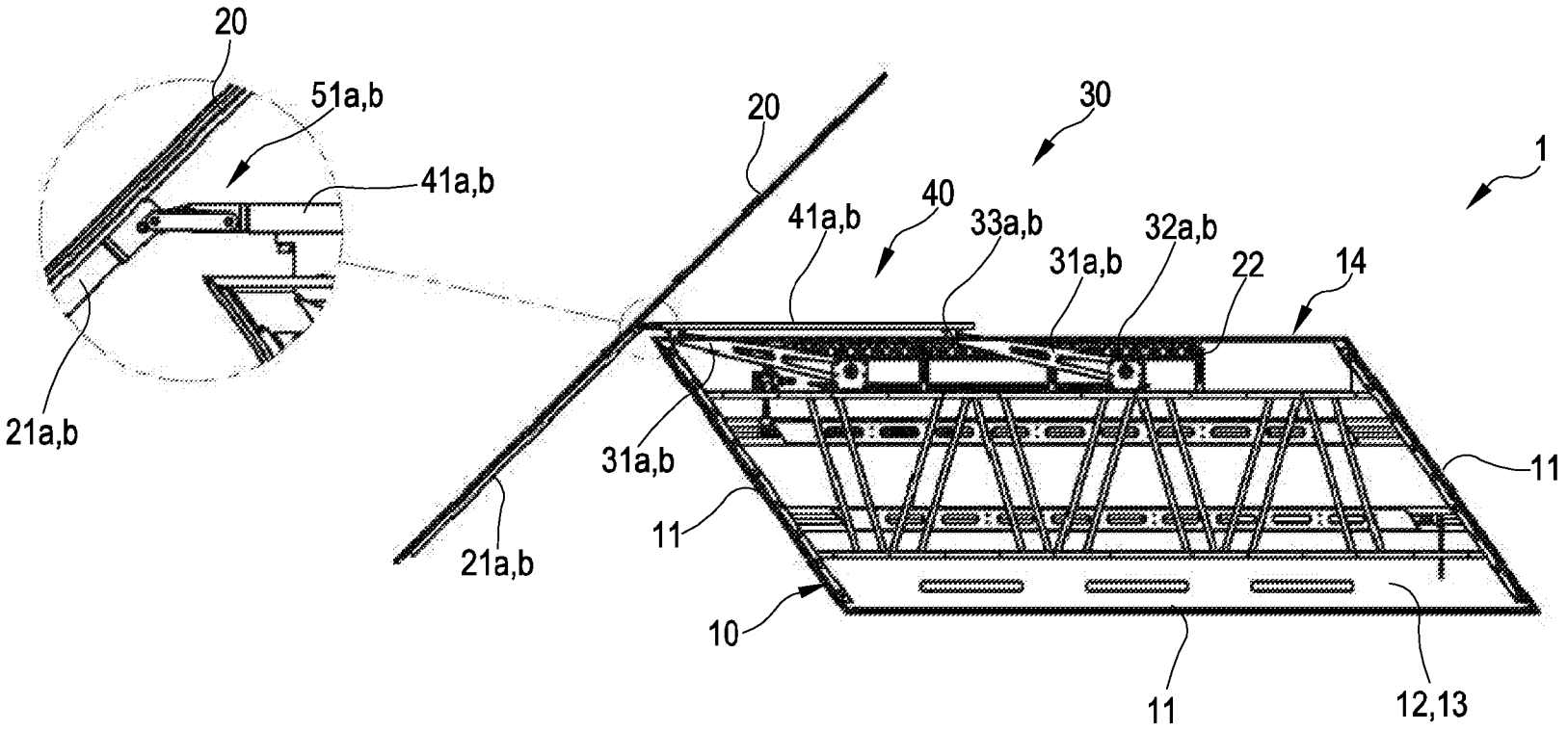
FIG. 4 is a schematic view from above of the showcase of FIG. 1, with openable panel in the step of passing from the partially open position to the totally open position.

The figures show a showcase 1 according to the invention, suitable for the preservation and display of objects. The showcase 1 comprises a fixed casing 10, with fixed side panels 11, a base block 12 and a top panel 13, mounted fixedly connected to each other around an opening space 14; in the base block 12 and/or in the top panel 13 possible apparatuses (per se known and not illustrated here) are housed for controlling the showcase 1, for example for controlling its illumination, security, climate-control. The showcase 1 also comprises at least one openable panel 20, typically made of glass, mounted in a sealed manner on the fixed casing 10 at the opening space 14, through opening supports 30. The seal between the openable panel 20 and the case 10 is ensured by gaskets, selected according to the sealing requirements of the specific showcase, not highlighted in the figures and per se known.

The opening supports 30 comprise a pair of upper rods 31*a* and a pair of lower rods 31*b* (also wholly indicated as rods 31) pivoted to the fixed casing 10 at respective first upper 32*a* and lower 32*b* rod pins (also wholly indicated as first pins 32). The opening supports 30 also comprise an intermediate structure 40, pivoted to the rods 31 at respective second upper 33*a* and lower 33*b* rod pins (also wholly indicated as second pins 33); the intermediate structure 40 comprises an upper bar 41*a* and a lower bar 41*b* (also wholly indicated as bars 41 of the intermediate structure 40), respectively pivoted to the upper 31*a* and lower rods 31*b* at the second upper 33*a* and lower 33*b* rod pins.

The rods 32 all have the same length, by length of the rod meaning the distance between the centres or axes of its pins. The first and second rod pins 32 and 33 all have pivoting axis parallel to a main direction X, which is preferably vertical, as shown in the figures. The distance on the fixed casing 10 between the first upper rod pins 32*a* and the distance on the upper bar 41*a* of the intermediate structure 40 between the second upper rod pins 33*a* are equal to each other; equally, the distance on the fixed casing 10 between the first lower rod pins 32*b* and the distance on the lower bar 41*b* of the intermediate structure 40 between the second lower rod pins 33*b* are equal to each other; preferably, the aforementioned four distances are all equal to each other, so as to simplify construction and mounting.

The four rods 31 thus form an articulated parallelogram system for the movement of the intermediate structure 40 with respect to the fixed casing 10.

The showcase 1 also comprises a hinging system along the main direction X, between the openable panel 20 and the intermediate structure 40, so as to allow the openable panel 20 to rotate with respect to the intermediate structure 40.

More specifically, the openable panel 20 comprises at least one upper bar 21*a* and a lower bar 21*b* (also wholly indicated as bars 21 of the openable panel 20), respectively pivoted to the upper bar 41*a* and to the lower bar 41*b* of the intermediate structure 40 through the hinging system. The hinging system comprises an upper hinge 51*a* between the upper bars 41*a* and 21*a* of the intermediate structure 40 and of the panel 20 and a lower hinge 51*b* between the lower bars 41*b* and 21*b* of the intermediate structure 40 and of the openable panel 20; the upper hinge 51*a* and the lower hinge 51*b* are also wholly indicated as hinges 51.

Figure 5:
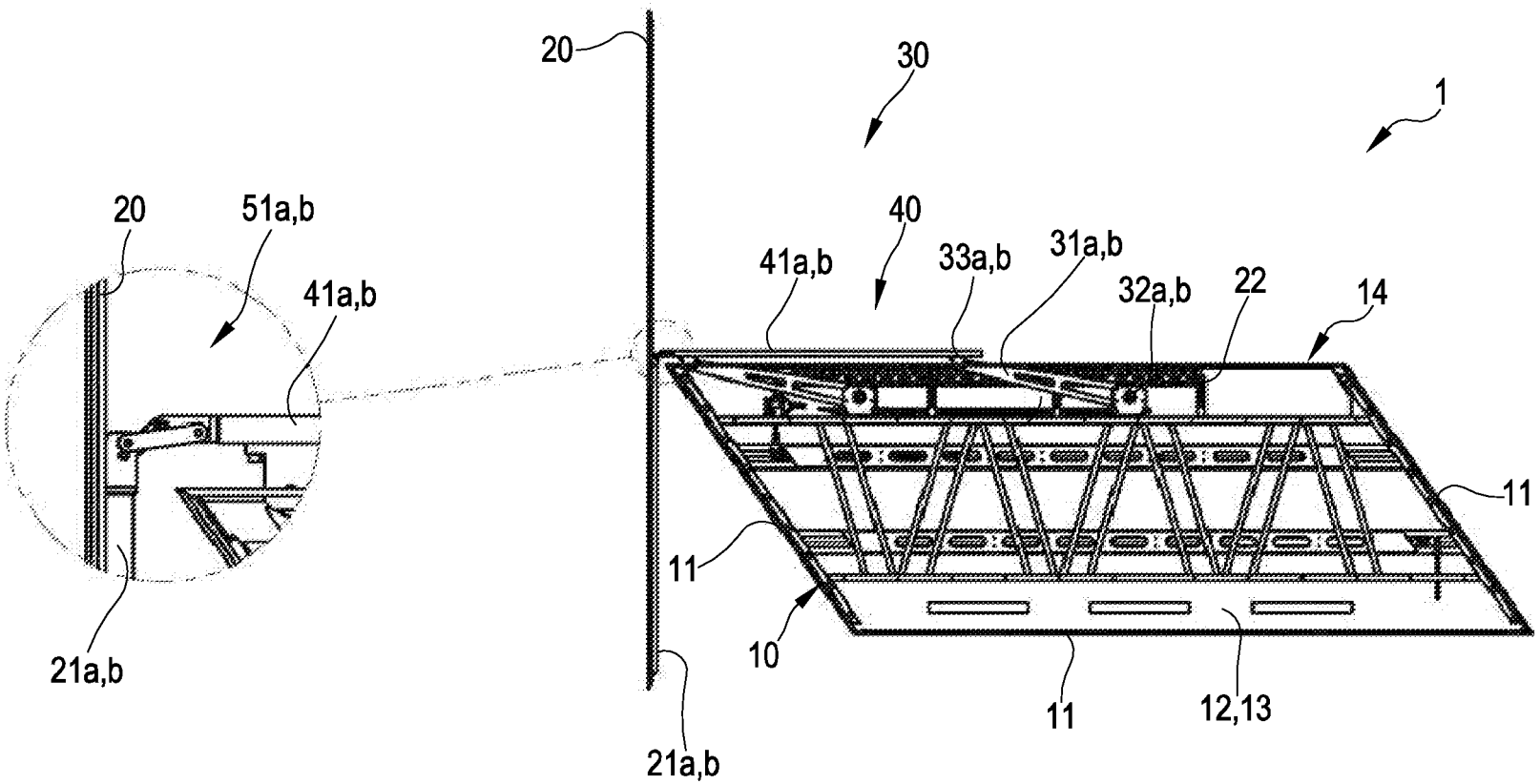
FIG. 5 is a further schematic view from above of the showcase of FIG. 1, with openable panel in the step of passing from the partially open position to the totally open position.
Figure 6:
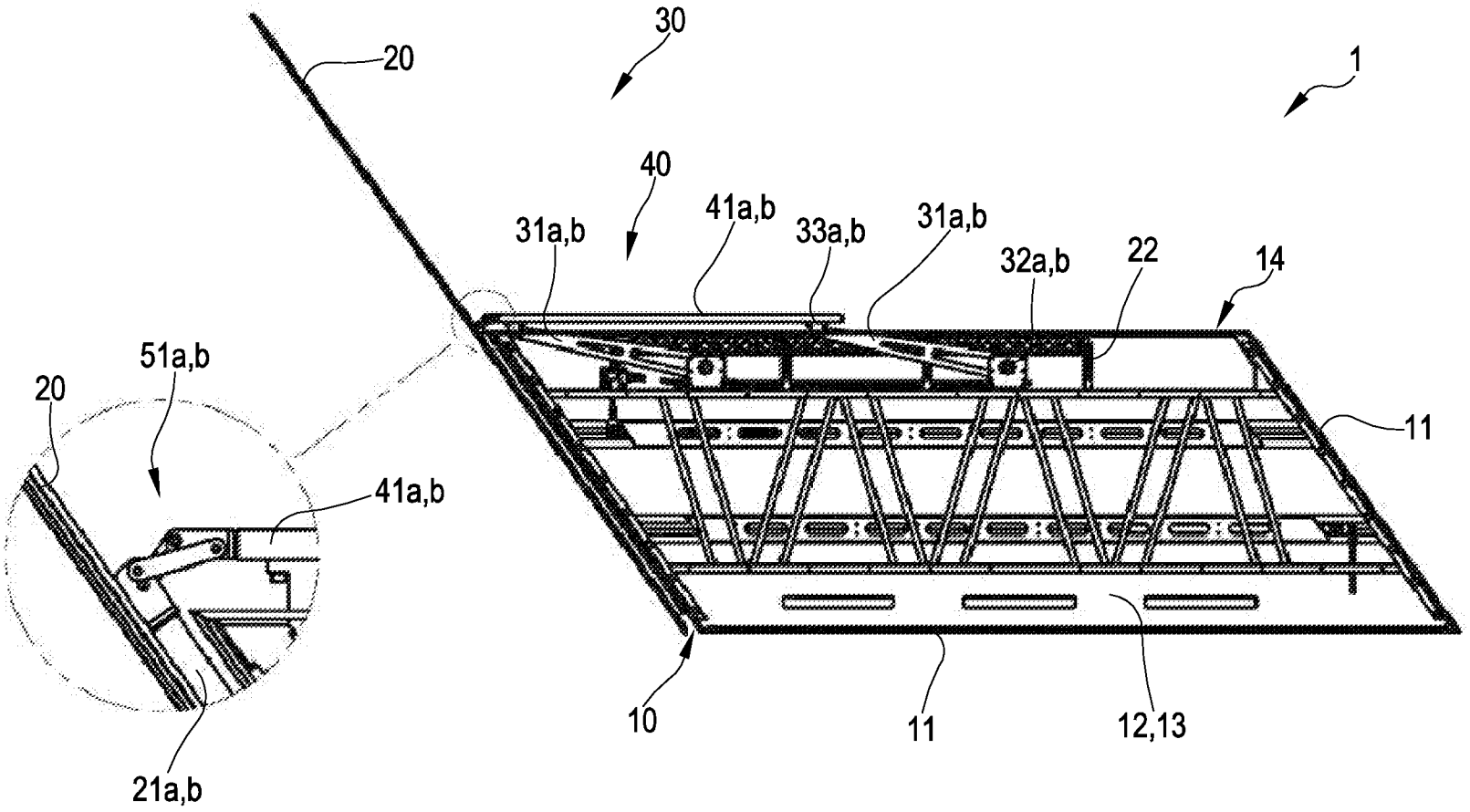
FIG. 6 is a schematic view from above of the showcase of FIG. 1, with openable panel in totally open position.
Figure 8:
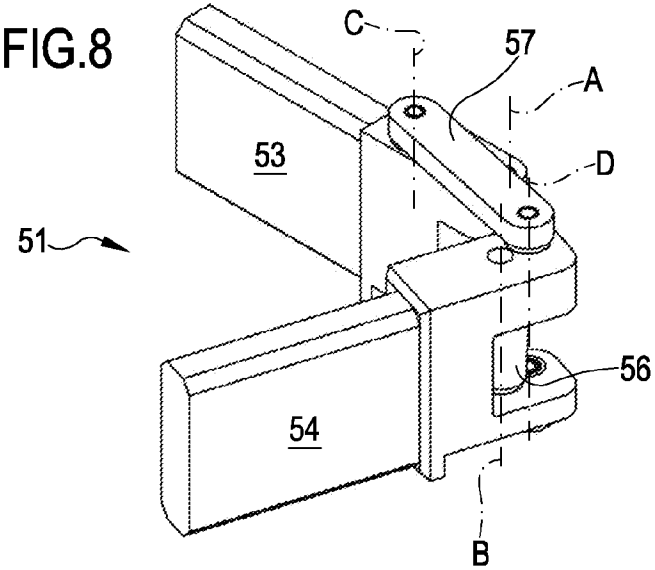
FIGS. 7-9 are perspective views taken from different directions of a detail of the showcase of FIG. 6.
Figure 7:
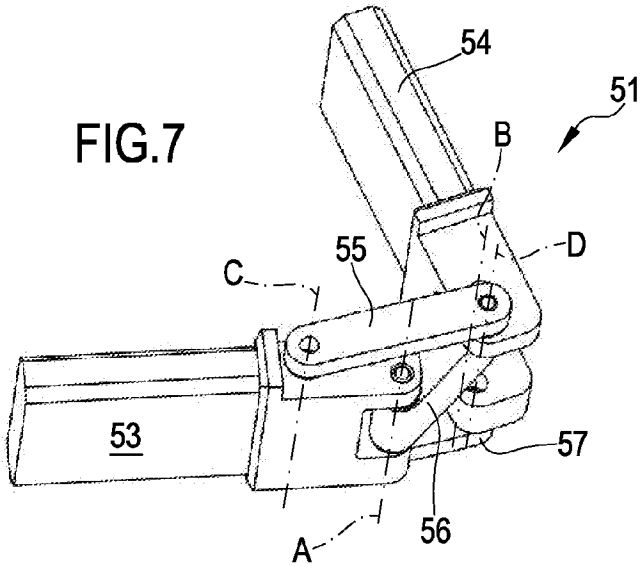
Figure 9:
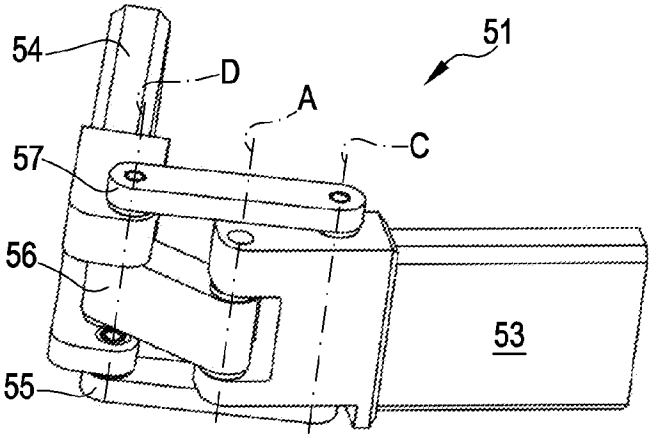

In the showcase 1, illustrated in FIG. 1-9, the hinges 51*a* and 51*b* are two roto-translational complex hinges, the same as each other, illustrated in greater detail in FIGS. 7-9. More specifically, each hinge 51 comprises a first fork 53 fixed to one of the bars 21 or 41, a second fork 54 fixed to the other of the bars 21 or 41, and three rods 55, 56, 57 pivoted between the first and the second fork 53, 54. The central rod 56 is pivoted to the first fork 53 between the opposite arms thereof according to a first pivoting axis A, and is pivoted to the second fork 54 between the opposite arms thereof according to a second pivoting axis B; the two outer rods 55 and 57 are pivoted to the first fork 53 externally with respect to the arms thereof according to a third pivoting axis C, and are pivoted to the second fork 54 externally with respect to the arms thereof according to a fourth pivoting axis D. The four pivoting axes A, B, C, D, are parallel to each other and to the main direction X. Moreover, on the first fork 53, the first pivoting axis A is located between the third pivoting axis C and the ends of the arms of the first fork 53 itself; on the second fork 54, the fourth pivoting axis D is located between the second pivoting axis B and the ends of the arms of the second fork 54.

The two hinges 51 are fixed with the respective first forks 53 to the bars 41 of the intermediate structure 40 and with the respective second forks 54 to the bars 21 of the openable panel 20. With respect to the openable panel 20, the hinges 51 are positioned at about half the width; the bars 21 of the openable panel 20 and the bars 41 of the intermediate structure 40 are about the same length. In closure conditions of the openable panel 20, the rods 31 are extended parallel to the openable panel 20 itself; the length of the rods 31 (as stated, taken as between the first and the second rod pins 32, 33) is equal to about one quarter of the width of the openable panel 20.

The showcase 1 also comprises support and sliding guides 22 mounted on the fixed casing 20, in the vicinity of the first rod pins 31, in a position such as to provide a support for the rods 31 when the openable panel 20 is in complete or partial closure and/or opening position. The guides 22 can be simple sliding blocks, made at least in the upper part with a low friction material, or—in the case of a particularly heavy openable panel 20—they can comprise arrays of balls or other revolving elements, possibly recirculating.

The operation of the showcase 1 is clear from its structure just described.

In the condition with the showcase 1 closed (FIG. 1), the rods 31 are extended substantially parallel to the openable panel 20 itself and rest on the guides 22. In order to open the showcase 1, the rods 31 are actuated simultaneously (manually or through motor means, in a per se known way). In a first step of opening, the openable panel 20, carried by the intermediate structure 40, is moved substantially away from the fixed casing 10 and then possible gasket means compressed between the openable panel 20 and the fixed casing 10 are unloaded. Continuing the actuation of the rods 31, the openable panel 20 is moved even further away from the fixed casing 10, thus leaving the support provided by the guides 22, until it is brought into a position (FIG. 2) the maximum distance away from the fixed casing 1 (equal to the length of the rods 31), with the rods 31 substantially perpendicular to the openable panel 20. In this position the rods 31 (and in particular the upper rods 31*a*) must safely support the weight of the openable panel 20. It should be noted that—in this position like in the others—the openable panel 20 is supported by the intermediate structure 40 in a substantially central, i.e. barycentric, position and consequently the risks of unbalancing of the openable panel 20 are reduced to the minimum, even in the case of high weight.

Proceeding with the actuation of the rods 31, the openable panel 20 goes back to being brought close to the fixed casing 10, finally going back to the support provided by the guides 22, until it is brought into a partially open position (FIG. 3), with the rods 31 once again substantially parallel to the openable panel 20. The first step of opening of the showcase 10 thus ends, in which the articulated parallelogram system formed by the rods 31 operates. In this position, the opening space 14 is in part free, in part obstructed by the openable panel 10; it is thus possible to have limited access to the inside of the showcase, suitable for sufficiently small objects, with difficulty accessing the inner area of the showcase 1 remote with respect to the free part of the opening space 14.

If more complete access to the inside of the showcase 1 is desired, it is necessary to activate the second step of the opening of the showcase 1, in which the rods 31 and the intermediate structure 40 now remain immobile. On the other hand, the openable panel 20 is moved with respect to the intermediate structure 40, exploiting the hinges 51; this movement can also be imposed manually or with suitable motor means (not illustrated). The trajectory of the movement of the openable panel 20 is in this step determined by the hinges 51 with roto-translation, which—thanks to their geometry with three rods described above—impose, together with the rotation, a translation in the direction to move the openable panel 20 away from the bars 41 of the intermediate structure and therefore from the fixed casing 10. The openable panel 20 can thus not only reach intermediate positions in which the opening space 14 is progressively more free (FIGS. 4 and 5), but can reach the final position (FIG. 6) in which it is adjacent to the outside of the side panel 11 of the fixed casing 10. It should be noted that this condition is reached, thanks to the invention, regardless of the particular shape of the showcase 1, with an acute edge that implies a rotation of the openable panel by well over 90° (about 125° in the example shown).

It should be noted that also in the totally open position the rods 31 that—through the intermediate structure 40—bear the weight of the openable panel 20 are rested on the guides 22; this ensures the maximum safety for workers during the installation or removal operations of the showcase 1.

The closure of the showcase 1 clearly takes place by carrying out the steps just described in reverse, thus passing from the condition shown in FIG. 6 to those shown progressively in FIGS. 5, 4, 3, 2 and 1. It should be noted, in particular, that at the end, close to the condition of FIG. 1, the openable panel 20 is moved by the rods 31 in the direction of approach substantially perpendicular to the fixed casing 10 and it is thus possible to carry out the compression of possible sealing gaskets.

FIGS. 10-15 show a showcase 101 according to a different embodiment of the invention. The difference between the showcase 101 and the showcase 1 described earlier is limited to the hinging system: instead of the two complex roto-translational hinges 51, two simple pin hinges 151 are provided. All of the other characteristics are the same and will not be described; in the drawings, the elements of the showcase 101 that are the same as the elements of the showcase 1 are marked by reference numerals increased by 100.

Figure 10:
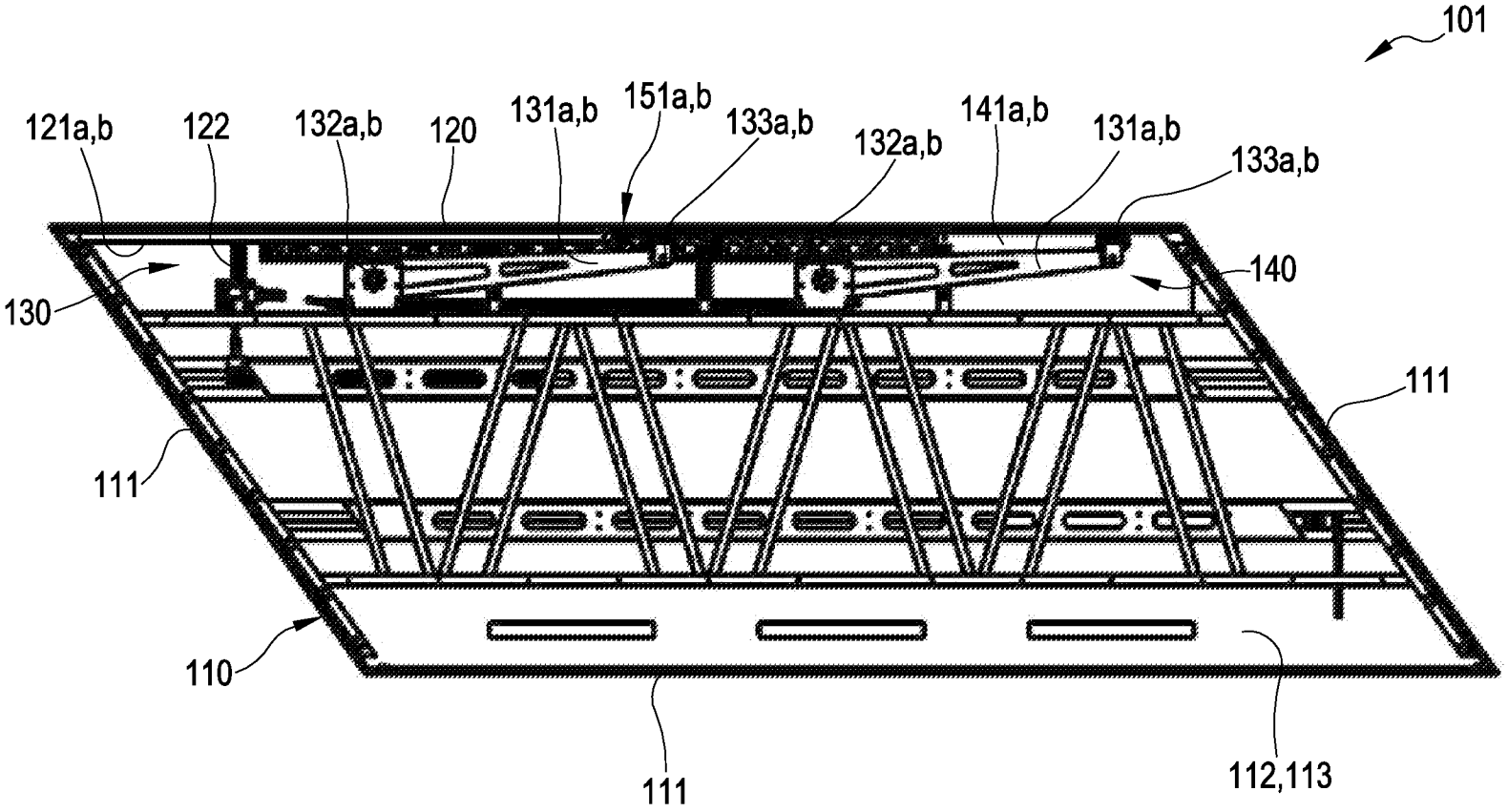
FIG. 10 is a schematic view from above of a showcase according to a second embodiment of the invention, with openable panel in closure position.
Figure 11:
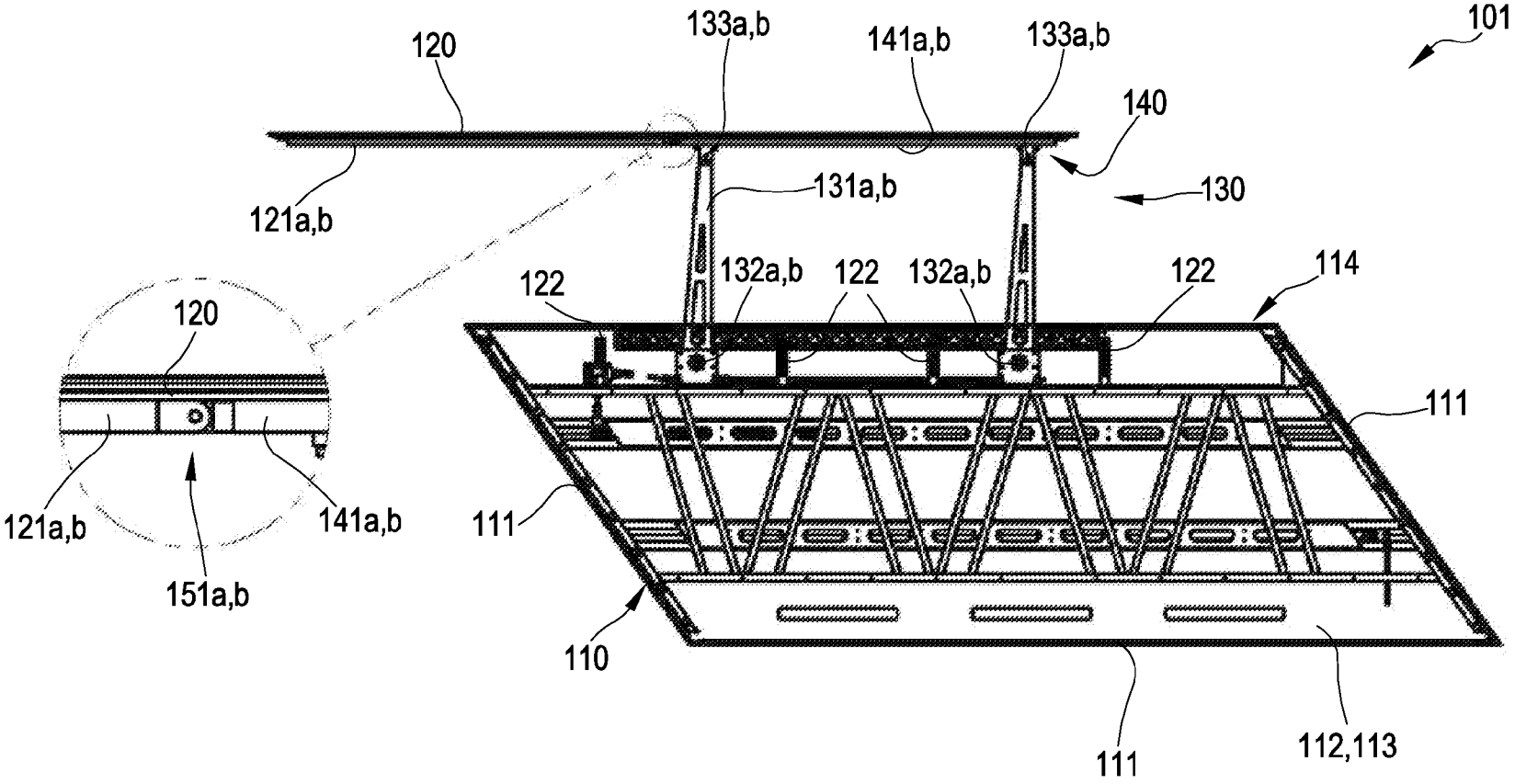
FIG. 11 is a schematic view from above of the showcase of FIG. 10, with openable panel in the step of passing from the closure position to the partially open position.
Figure 12:
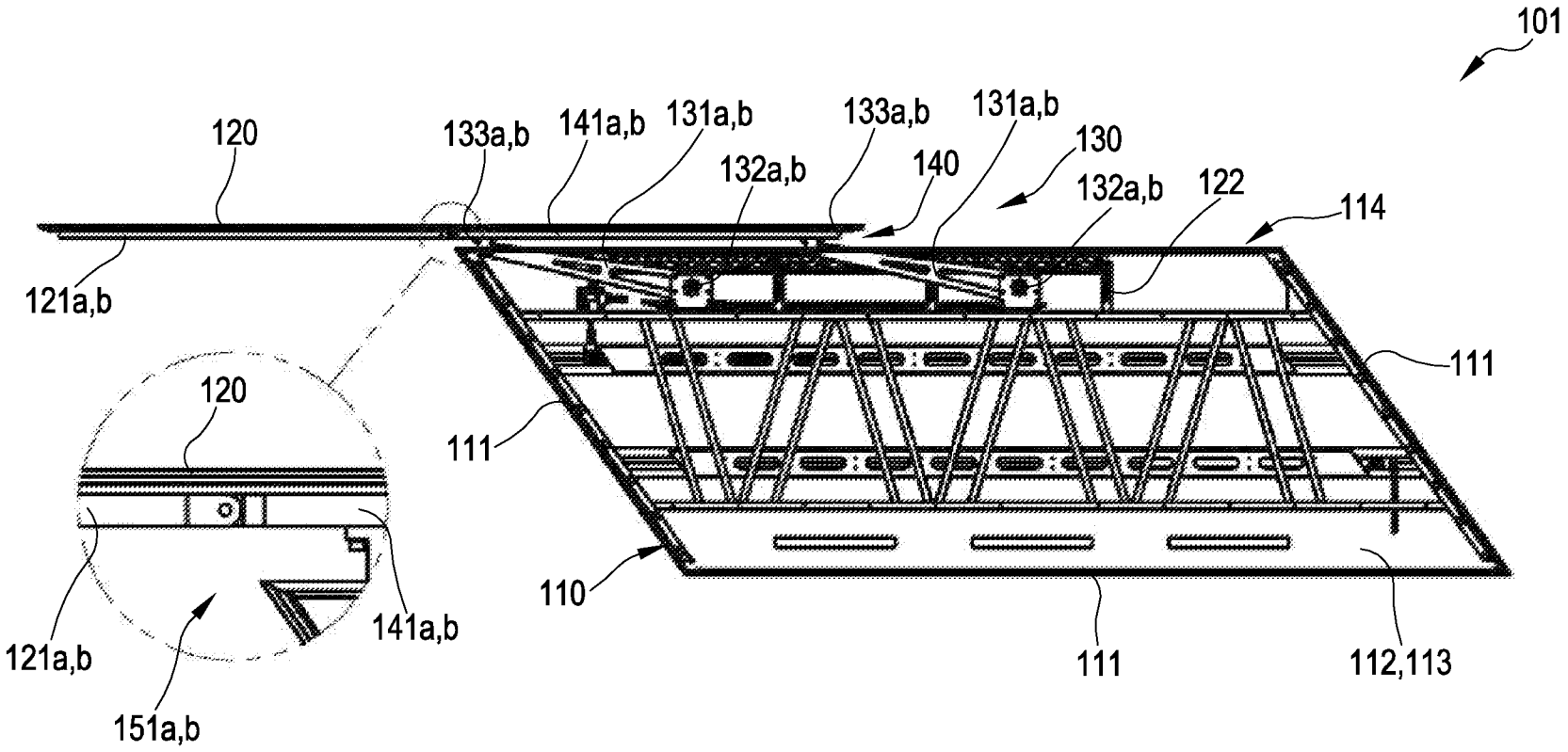
FIG. 12 is a schematic view from above of the showcase of FIG. 10, with openable panel in partially open position.
Figure 13:
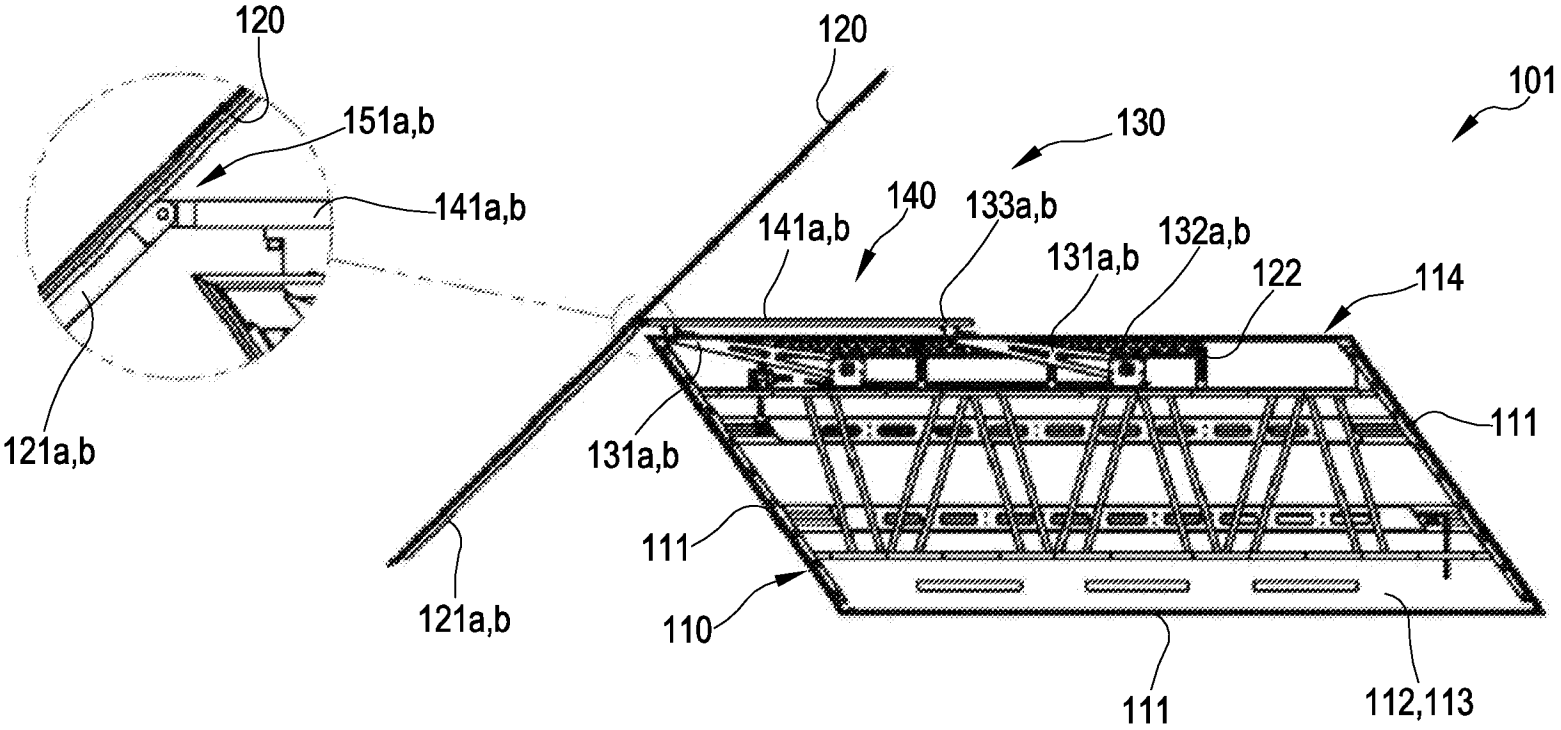
FIG. 13 is a schematic view from above of the showcase of FIG. 10, with openable panel in the step of passing from the partially open position to the totally open position.

In FIGS. 10-15, the showcase 101 is indeed shown with the same dimensions and configuration as the showcase 1, so as to be able to highlight the differences due to the different hinges 151. The closure condition of the showcase 101 shown in FIG. 10 is indeed identical to the closure condition of the showcase 1 shown in FIG. 1; the partially open condition of the showcase 101 shown in FIG. 12 is also identical to the partially open condition of the showcase 1 shown in FIG. 3. The intermediate conditions are also identical: the intermediate conditions of the showcase 101 shown in FIGS. 11 and 13 are respectively identical to the intermediate conditions of the showcase 1 shown in FIGS. 2 and 4.

Figure 14:
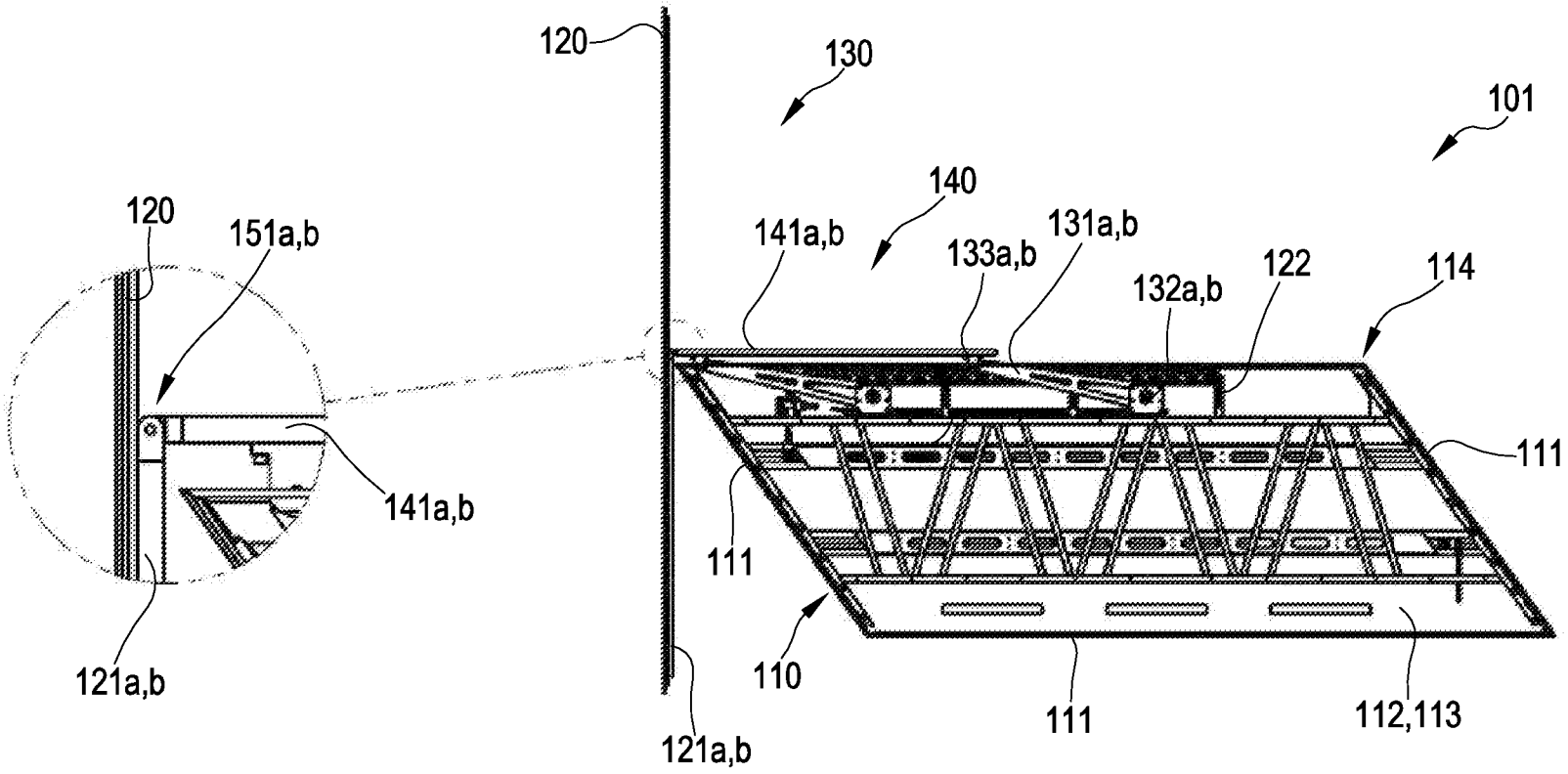
FIG. 14 is a further schematic view from above of the showcase of FIG. 10, with openable panel in totally open position.
Figure 15:
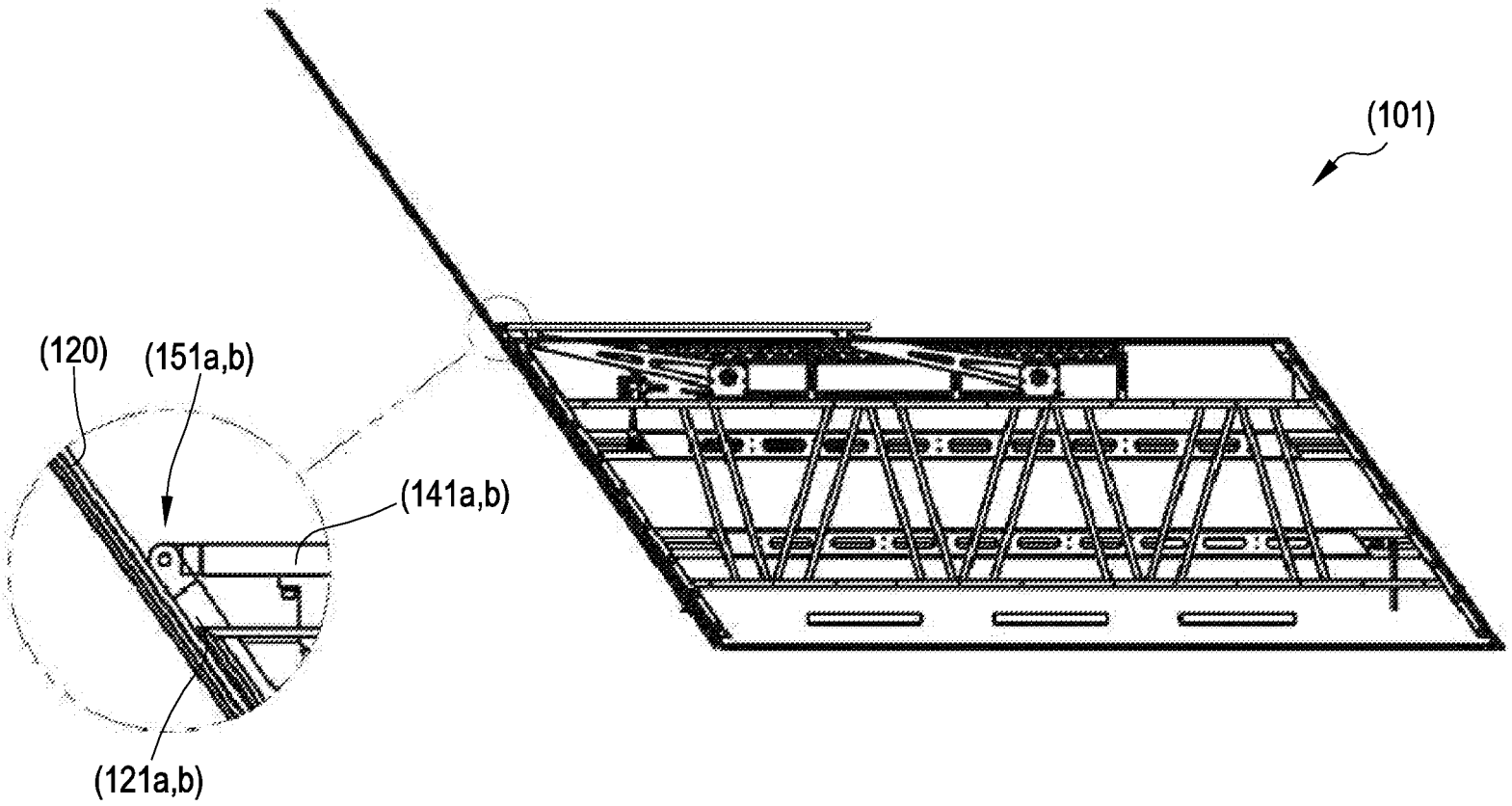
FIG. 15 is an imaginary schematic view from above of the showcase of FIG. 10, which shows how it is not possible with the showcase of FIG. 10 to have total opening analogous to that of the showcase of FIG. 1 (shown in FIG. 6)

The difference can be appreciated in the comparison of the conditions of the showcase 101 shown in FIG. 14 with those of the showcase 1 shown in FIG. 5, conditions in which the openable panel 20, 120 is in both cases substantially rotated by 90° with respect to the closed position: whereas for the showcase 1 FIG. 5 shows an intermediate open condition (thus with possibility of further substantial roto-translation up to the totally open position of FIG. 6), FIG. 14 shows a substantially totally open condition for the showcase 101. Indeed, as shown by FIG. 14 (and particularly by the enlarged detail), a further rotation of the openable panel 120, even by a few degrees, is no longer possible, because it causes an interference with the fixed casing 110; consequently, FIG. 15 shows an unreal situation, in which in the drawing the openable panel 120 overlaps the fixed casing 110, which is clearly impossible in reality.

As a result the showcase 101, with the simple pin hinges 151, is simpler and probably more cost-effective, but is not suitable for showcases in which very wide opening, of over 90°, is necessary.

Figure 16:
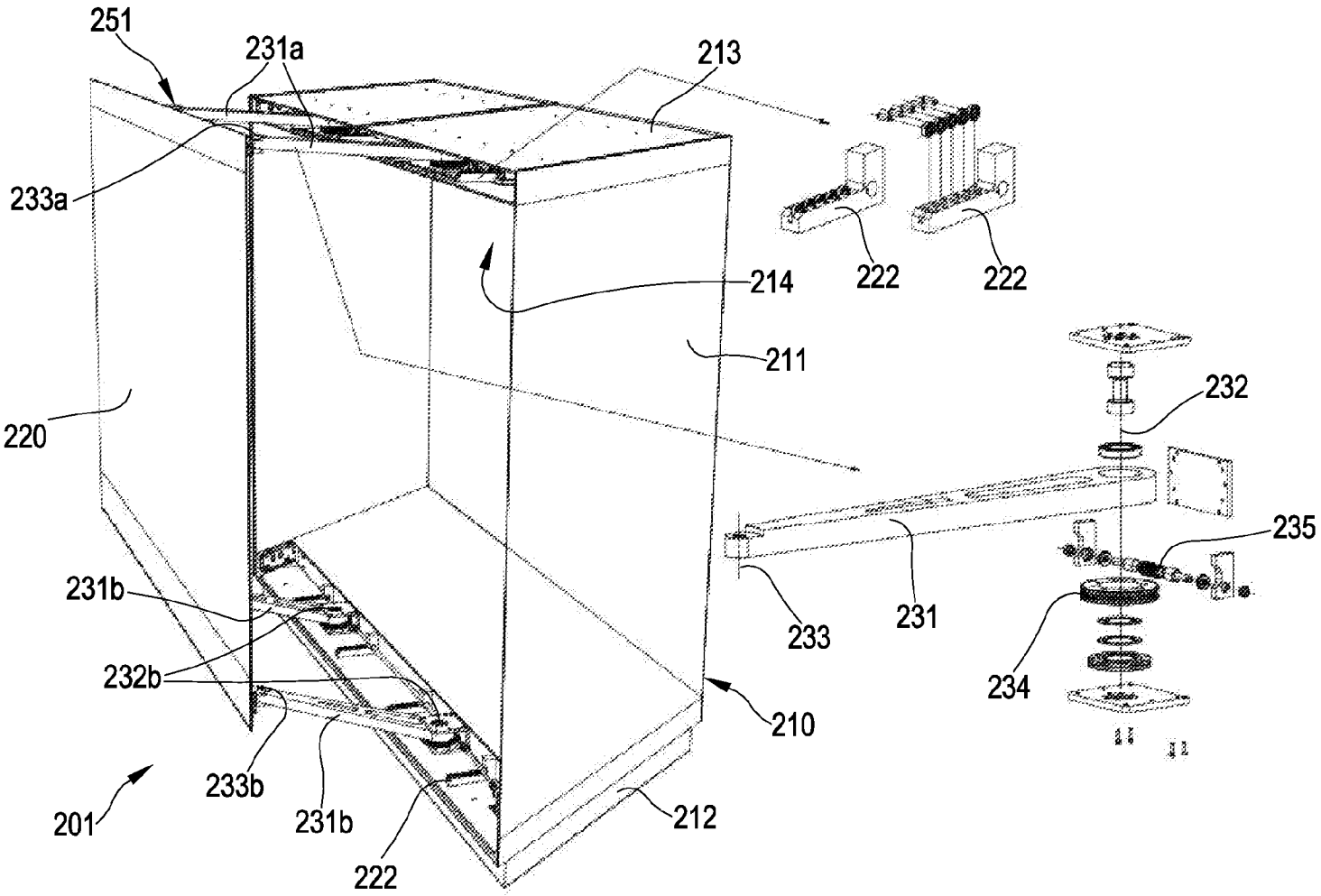
FIG. 16 is a perspective view of a showcase analogous to the showcases of FIGS. 1 and 10, with some details highlighted and exploded.

FIG. 16 shows a showcase 201 according to a different embodiment of the invention. The difference between the showcase 201 and the showcases 1 and 101 described earlier is limited to the shape of the showcase, now with a rectangular-shaped plan rather than parallelogram-shaped. All of the characteristics are the same and will not be described; in the drawings, the elements of the showcase 201 that are the same as the elements of the showcase 1 are marked by reference numerals increased by 200.

FIG. 16 does not illustrate in detail the hinges 251, which can therefore be both roto-translational complex hinges the same as the hinges 51, and simple pin hinges the same as the hinges 151. Moreover, FIG. 16 better shows some details of the invention, such as the rods 231 and the support guides 222; it is thus possible to see part of an actuation system of the rods 231, with a toothed wheel 234 set in rotation by a worm screw shaft 235, which can in turn be actuated by an electric motor or by a crank, in a per se known way.

The invention claimed is:

1. A showcase for preservation and display of objects, comprising a fixed casing and at least one openable panel made of glass mounted on the fixed casing through opening supports, wherein the opening supports comprise:

a pair of upper rods and a pair of lower rods, all having a same length, pivoted to the fixed casing at respective first upper and lower rod pins;

an intermediate structure, pivoted to the upper and lower rods at respective second upper and lower rod pins;

wherein the rod pins have a pivoting axis parallel to a main direction;

wherein the distance on the fixed casing between the first upper rod pins and the distance on the intermediate structure between the second upper rod pins are equal to each other, as well as the distance on the fixed casing between the first lower rod pins and the distance on the intermediate structure between the second lower rod pins are equal to each other, so that the four rods form an articulated parallelogram system for the movement of the intermediate structure with respect to the fixed casing;

and a hinging system along the main direction, between the openable panel and the intermediate structure, so as to allow the openable panel to rotate with respect to the intermediate structure.

2. The showcase according to claim 1, wherein the intermediate structure comprises at least an upper bar and a lower bar, respectively hinged to the upper and lower rods at the second upper and lower rod pins.

3. The showcase according to claim 2, wherein the openable panel comprises at least an upper bar and a lower bar, respectively pivoted to the upper bar and to the lower bar of the intermediate structure through the hinging system.

4. The showcase according to claim 3, wherein the hinging system comprises an upper hinge between the upper bars of the intermediate structure and of the openable panel and a lower hinge between the lower bars of the intermediate structure and the openable panel.

5. The showcase according to claim 4, wherein the upper hinge and the lower hinge are two roto-translational complex hinges.

6. The showcase according to claim 5, wherein each of the two roto-translational complex hinges comprises a first fork fixed to one of the bars, a second fork fixed to the other of the bars, and three rods pivoted between the first and the second fork, wherein:

a central one of the rods is pivoted to the first fork between opposite arms thereof according to a first pivoting axis, the central rod is pivoted to the second fork between opposite arms thereof according to a second pivoting axis, two outer ones of the rods are pivoted to the first fork, externally with respect to the arms thereof, according to a third pivoting axis, the two outer rods are pivoted to the second fork, externally with respect to the arms thereof, according to a fourth pivoting axis, wherein the four pivoting axes are parallel to each other and to the main direction, and wherein in addition:

on the first fork, the first pivoting axis is located between the third pivoting axis and the ends of the arms of the first fork, on the second fork, the fourth pivoting axis is located between the second pivoting axis and the ends of the arms of the second fork.

7. The showcase according to claim 6, wherein the two complex hinges are fixed with the respective first forks to the bars of the intermediate structure and with the respective second forks to the bars of the openable panel.

8. The showcase according to claim 4, wherein the upper hinge and the lower hinge are two simple pin hinges.

9. The showcase according to claim 1, wherein the hinging system is positioned at about half the width of the openable panel.

10. The showcase according to claim 9, wherein the rods, in the closure condition of the openable panel, are extended parallel to the openable panel, and wherein the length of the rods between the first and the second rod pins is about a quarter of the width of the openable panel.

11. The showcase according to claim 1, wherein the main direction is vertical.

12. The showcase according to claim 11, comprising support and slide guides mounted on the fixed casing in a position on which the rods can rest when the openable panel is in a complete or partial closure and/or opening position.

13. A showcase for preservation and display of objects, comprising a fixed casing and at least one openable panel made of glass mounted on the fixed casing through opening supports, wherein the opening supports comprise:

a pair of upper rods and a pair of lower rods, all having a same length, pivoted to the fixed casing at respective first upper and lower rod pins;

an intermediate structure, pivoted to the upper and lower rods at respective second upper and lower rod pins;

wherein:

the rod pins have a pivoting axis parallel to a main direction, the distance on the fixed casing between the first upper rod pins and the distance on the intermediate structure between the second upper rod pins are equal to each other, as well as the distance on the fixed casing between the first lower rod pins and the distance on the intermediate structure between the second lower rod pins are equal to each other, so that the four rods form an articulated parallelogram system for the movement of the intermediate structure with respect to the fixed casing, a hinging system along the main direction, between the openable panel and the intermediate structure, so as to allow the openable panel to rotate with respect to the intermediate structure, the intermediate structure comprises at least an upper bar and a lower bar, respectively hinged to the upper and lower rods at the second upper and lower rod pins, the openable panel comprises at least an upper bar and a lower bar, respectively pivoted to the upper bar and to the lower bar of the intermediate structure through the hinging system, the hinging system comprises an upper hinge between the upper bars of the intermediate structure and of the openable panel and a lower hinge between the lower bars of the intermediate structure and the openable panel, and the upper hinge and the lower hinge are two roto-translational complex hinges.

14. A showcase for preservation and display of objects, comprising a fixed casing and at least one openable panel made of glass mounted on the fixed casing through opening supports, wherein the opening supports comprise:

a pair of upper rods and a pair of lower rods, all having a same length, pivoted to the fixed casing at respective first upper and lower rod pins;

an intermediate structure, pivoted to the upper and lower rods at respective second upper and lower rod pins;

wherein:

the rod pins have a pivoting axis parallel to a main direction, the distance on the fixed casing between the first upper rod pins and the distance on the intermediate structure between the second upper rod pins are equal to each other, as well as the distance on the fixed casing between the first lower rod pins and the distance on the intermediate structure between the second lower rod pins are equal to each other, so that the four rods form an articulated parallelogram system for the movement of the intermediate structure with respect to the fixed casing, a hinging system along the main direction, between the openable panel and the intermediate structure, so as to allow the openable panel to rotate with respect to the intermediate structure, and the hinging system is positioned at about half the width of the openable panel.

* * * * *